US005968211A

United States Patent [19]

Schilowitz

[11] Patent Number: 5,968,211

[45] Date of Patent: Oct. 19, 1999

[54] GASOLINE ADDITIVE CONCENTRATE

[75] Inventor: Alan M. Schilowitz, Highland Park, N.J.

[73] Assignee: Exxon Research and Engineering Co., Florham Park, N.J.

[21] Appl. No.: 09/085,400

[22] Filed: May 26, 1998

Related U.S. Application Data

[63] Continuation-in-part of application No. 08/853,849, May 9, 1997, abandoned, which is a continuation-in-part of application No. 08/577,658, Dec. 22, 1995, abandoned.

[51] Int. Cl.[6] ..... C10L 1/22; C10L 1/18

[52] U.S. Cl. ..... 44/402; 44/408; 44/411

[58] Field of Search ..... 44/402, 411

[56] References Cited

U.S. PATENT DOCUMENTS

| | | | |
|---|---|---|---|
| 2,862,800 | 12/1958 | Cantrell et al. | 44/66 |
| 2,902,353 | 9/1959 | Becker et al. | 44/71 |
| 2,996,366 | 8/1961 | Churchill et al. | 44/66 |
| 3,279,901 | 10/1966 | Robbins et al. | 44/66 |
| 3,391,077 | 7/1968 | Osborne | 208/256 |
| 3,442,630 | 5/1969 | Weldon et al. | 44/66 |
| 3,454,381 | 7/1969 | Eckhert | 44/66 |
| 3,873,278 | 3/1975 | Polss | 44/66 |
| 3,955,940 | 5/1976 | Hollyday | 44/62 |
| 3,981,682 | 9/1976 | Ward et al. | 21/2.7 |
| 3,996,024 | 12/1976 | Coon | 44/71 |
| 4,083,698 | 4/1978 | Wenzel et al. | 44/81 |
| 4,248,182 | 2/1981 | Malec | 123/1 |
| 4,365,973 | 12/1982 | Irish | 44/56 |
| 4,398,921 | 8/1983 | Rifkin et al. | 44/56 |
| 4,426,208 | 1/1984 | Perilstein | 44/56 |
| 4,440,545 | 4/1984 | Weidig | 44/56 |
| 4,448,586 | 5/1984 | Weidig | 44/55 |
| 4,451,265 | 5/1984 | Schwab | 44/51 |
| 4,508,540 | 4/1985 | Perilstein | 44/53 |
| 4,511,366 | 4/1985 | Barrows et al. | 44/53 |
| 4,521,219 | 6/1985 | Perilstein | 44/55 |
| 4,549,882 | 10/1985 | Knapp | 44/53 |
| 4,565,547 | 1/1986 | Takada | 44/51 |
| 4,581,039 | 4/1986 | Horodysky | 44/71 |
| 4,617,026 | 10/1986 | Schaub | 44/70 |
| 4,737,159 | 4/1988 | Phillips | 44/53 |
| 4,780,111 | 10/1988 | Dorer et al. | 44/71 |
| 4,797,134 | 1/1989 | Vataru | 44/66 |
| 4,804,389 | 2/1989 | Johnston et al. | 44/70 |
| 5,004,479 | 4/1991 | Schon et al. | 44/302 |
| 5,006,130 | 4/1991 | Aiello et al. | 44/432 |
| 5,080,686 | 1/1992 | Garrecht et al. | 44/351 |
| 5,197,997 | 3/1993 | Mozdzen et al. | 44/386 |
| 5,279,626 | 1/1994 | Cunningham et al. | 44/331 |
| 5,360,460 | 11/1994 | Mozdzen et al. | 44/386 |
| 5,569,407 | 10/1996 | Avery et al. | 508/454 |

FOREIGN PATENT DOCUMENTS

| | | | |
|---|---|---|---|
| 0482253 | 10/1990 | European Pat. Off. | C01L 1/22 |
| 1074232 | 6/1964 | United Kingdom | C10L 1/22 |
| 2269824 | 8/1993 | United Kingdom | C10L 1/22 |
| 9502654 | 1/1995 | WIPO | C10L 1/02 |
| 9503377 | 2/1995 | WIPO | C10L 1/14 |

OTHER PUBLICATIONS

Petrolite Performance Additives, Product Research Guide, "Lubricity Additives", 1995, Petrolite Corporation, St. Louis, MO.

*Primary Examiner*—Ellen M. McAvoy
*Attorney, Agent, or Firm*—Joseph J. Allocca

[57] ABSTRACT

The present invention is a gasoline additive concentrate which remains liquid at low temperatures of about 0° F. which contains a fatty acid, ester or mixtures thereof in combination with an alcohol, an amine or a mixture thereof.

31 Claims, No Drawings

GASOLINE ADDITIVE CONCENTRATE

This application is a Continuation-In-Part of U.S. Ser. No. 853,849, filed May 9, 1997 (now abandoned) which is a Continuation-In-Part of U.S. Ser. No. 577,658 filed Dec. 22, 1995 (now abandoned).

BACKGROUND OF THE INVENTION

1. Field of the Invention

The present invention relates to a gasoline additive concentrate containing solubilizers to maintain the concentrate in the liquid state at low temperatures.

2. Description of the Related Art

U.S. Pat. No. 4,617,026 is directed to a method for reducing the fuel consumption in an automotive internal combustion engine by employing a gasoline fuel containing an effective fuel consumption reducing amount of an additive which is a hydroxyl-containing ester of a monocarboxylic acid and a glycol or trihydric alcohol, said ester additive having at least one free hydroxyl group.

U.S. Pat. No. 5,279,626 is directed to a fuel additive concentrate having an enhanced shelf life, the concentrate comprising a major amount of detergent/dispersant, a minor amount of demulsifier and an amount of solvent stabilizer sufficient to enhance the shelf life of the fuel additive package. The solvent stabilizer is formed from at least one aromatic hydrocarbon solvent and at least one alkyl or cycle alkyl alcohol wherein the solvent stabilizer composition contains more than 50 wt % aromatic hydrocarbon solvent and 10 to less than 50 wt % alcohol. The demulsifiers include organic sulfonates, polyoxyalkylene glycols, oxyalkylated phenolic resins and the like. Other components can be present in the concentrate including anti-oxidants, corrosion inhibitors, emission control additives, lubricity additives, antifoamants, biocides, dyes, octane or cetane improvers and the like. Corrosion inhibitors include dimers and trimer acids such as those produced from tall oil fatty acids, oleic acid, linoleic acid, and the like.

U.S. Pat. No. 5,360,460 teaches a composition and method relating to diesel fuel, the fuel additive comprising an alkylene oxide condensate or the reaction product thereof and an alcohol, a monocarboxylic fatty acid and a hydrocarbyl amine or the reacting product thereof and an alkylene oxide. An additional component can be a hydrocarbyl substituted dicarboxylic acid. The fuel additive can also contain a hydrocarbon solvent such as xylene. The fuel additive is also disclosed as being useful in gasoline fuel.

SUMMARY OF THE INVENTION

Most gasolines are additized by injecting a homogeneous, low viscosity and liquid additive concentrate into the gasoline while it is being loaded into trucks at the terminal rack. Commonly such additives are diluted in an aromatic solvent (e.g., xylene, aromatic 100, heavy aromatic naphtha) to produce a homogeneous, low viscosity fluid which is suitable for rack injection.

Obviously, the additive solution must be fluid, homogenous and low viscosity under all atmospheric conditions encountered at such outdoor truck loading facilities. Unfortunately, additives such as Tolad 9103 (a mixture of polymerized fatty acids, non-polymerized fatty acids and heavy aromatic naphtha, commercially available from Petrolite Corp.) is not suitable for additization under low temperature. It turns solid by 0° F. within one day.

It has been discovered that fatty acids, oligomers of such acids and the esters of such acids, useful as anti friction and wear reducing additives in gasoline and diesel fuels are formulated into an additive concentrate which remains liquid at low temperatures of down to about 0° F. by the additional presence in the concentrate of an alcohol, an amine or a mixture of alcohol and amine. The fatty acids and their esters are typically derived from naturally occurring fats and oils and includes those known as tall oil acids and their esters.

The concentrate comprises fatty acids, oligomers of fatty acids, their esters and mixtures thereof in an aromatic solvent diluent and further a $C_2$ to $C_{10}$ alcohol, preferably a $C_2$ to $C_8$ alcohol, most preferably ethanol, which remains liquid at temperatures of at least as low as 0° C. (32° F.), a $C_{12}$ to $C_{100}$ amine having at least one nitrogen, preferably a $C_{12}$ to $C_{18}$ amine and which has a glass transition temperature or is liquid at temperatures of at least as low as 0° C. (32° F.), and mixtures of such alcohols and amines.

The concentrate comprises a lubricity additive selected from the group consisting of saturated or unsaturated fatty acids, oligomerized saturated or unsaturated fatty acids, primarily dimerized and trimerized acids, their esters and mixtures thereof, preferably the acid(s), in an aromatic solvent, preferably an aromatic solvent of 8 to 14 carbons, the acid(s), ester(s) or mixture thereof being present in the solvent in an amount of about 85 wt % or less, preferably about 50 wt % or less, more preferably 30 wt % or less, and a compatibilizer selected from the group consisting of an alcohol, a $C_{12}$–$C_{50}$ amine, or a mixture of alcohol and $C_{12}$–$C_{100}$ amine wherein, the alcohol or amine when used individually is present in an amount of at least about 30 wt % preferably about 35 wt %, more preferably about 40 wt % most preferably about 50 wt % based on the acid(s), ester(s) or mixture thereof, preferably when the lubricity additive component concentration in the diluent is about 50 wt % or less, preferably about 30 wt %, and the combination alcohol plus amine is used in an amount of about 10 to 50 wt %, more preferably about 10 to 20 wt % based on the acid(s), ester(s) or mixture thereof, preferably when the lubricity additive component concentration in the solvent is about 30 wt % and higher, preferably about 50 wt % and higher and wherein the weight ratio of alcohol to amine in the mixture is about 2:10 to 10:1, preferably 3:10 to 10:5 most preferably 1:1, and when the acid(s), ester(s) or mixtures thereof are present in the solvent in an amount of between about 85 wt % to 8 wt %, preferably between about 75 wt % to 10 wt %, more preferably between about 50 wt % to 10 wt %, most preferably between about 30 wt % to 10 wt %, the amine compatibilizer when used alone is a $C_{51}$–$C_{100}$ amine present in an amount of at least about 30 wt %, preferably about 35 wt %, more preferably about 40 wt %, most preferably about 50 wt % based on the acid(s), ester(s) or mixture thereof, and the concentrate containing less than about 2 wt % water, preferably about 1 wt % and less water, most preferably about 0.2 wt % and less water.

The invention is further understood with reference to the following examples.

EXAMPLE 1

The data tabulated below (Table 1) (blends 17 and 18) demonstrate that additional aromatic solvent (i.e., Aromatic 100 an aromatic solvent with an average carbon number between 9 and 11) does not effectively keep Tolad 9103 lubricity additive in the fluid state. There may be some very high level of aromatic solvent which may be sufficient to keep Tolad 9103 fluid at low temperatures. However, in practice it is desirable to keep the total amount of injected material at a minimum. This reduces transportation cost of the total package. Typical injection systems also have a maximum injection volume capacity. Large amounts of volatile aromatic solvents are also undesirable from an environmental viewpoint. They increase air discharge of volatile organic compounds.

TABLE 1

ALL COMPATIBILITY TESTS DONE AT 0° F.

| Blend No. | Aromatic 100 gms | T9103 gms | Alcohol Type | Alcohol gms | Amine type | Amine gms | Status after 3 days | Status after 7 days | Status after 13 days |
|---|---|---|---|---|---|---|---|---|---|
| 17 | 10 | 3 | none | | none | | ppt | ppt | ppt |
| 18 | 10 | 5 | none | | none | | ppt | ppt | ppt |

EXAMPLE 2

The following blends (Table 2) contain 10 grams of Aromatic 100 solvent and 3 grams of Tolad 9103 in addition to various compatibilizing agents. Data below demonstrate that alcohol is an effective compatibilizer of Tolad 9103. Exxal 8 (iso-octanol) and ethanol are both effective. In addition, BASF Pluradyne FD-100 (poly isobutenyl monoamine having approximately 70 carbons) is also very effective. Hitec 4956, a mannich base polyamine fuel detergent sold by Ethyl, is partially effective. Armeen HT-97 an amine which is not liquid at room temperature, did not function as a compatibilizer. Ethomeen C/12 is an ethoxylated cocoa alkylamine purchased from Akzo Chemical Co.

TABLE 2

| Blend No. | Aromatic 100 gms | T9103 gms | Alcohol Type | Alcohol gms | Amine Type | Amine gms | Status after 3 days | Status after 7 days | Status after 13 days |
|---|---|---|---|---|---|---|---|---|---|
| 1 | 10 | 3 | none | | FD100 | 1 | no ppt | no ppt | no ppt |
| 2 | 10 | 3 | none | | Ethomeen C/12 | 1 | film | ppt | ppt |
| 3 | 10 | 3 | none | | Hitec | 1 | no ppt | no ppt | ppt |
| 4 | 10 | 3 | Exxal 8 | 1 | none | | no ppt | no ppt | no ppt |
| 5 | 10 | 3 | none | | S600N* | 1 | ppt | ppt | ppt |
| 7 | 10 | 3 | none | | Armeen HT-97 | 1 | ppt | ppt | ppt |
| 8 | 10 | 3 | EtOH | 1 | none | | no ppt | no ppt | no ppt |
| 17 | 10 | 3 | none | | none | | ppt | ppt | ppt |
| 22 | 10 | 3 | Exxal 8 | 0.5 | Armeen HT-97 | 0.5 | no ppt | ppt | ppt |
| 23 | 10 | 3 | Exxal 8 | 0.5 | FD100 | 0.5 | no ppt | no ppt | no ppt |
| 24 | 10 | 3 | Exxal 8 | 0.5 | Ethomeen C/12 | 0.5 | ppt | ppt | ppt |
| 25 | 10 | 3 | Exxal 8 | 0.5 | Hitec | 0.5 | no ppt | ppt | ppt |
| 29 | 10 | 3 | EtOH | 0.5 | Armeen HT-97 | 0.5 | ppt | ppt | ppt |
| 30 | 10 | 3 | EtOH | 0.5 | FD100 | 0.5 | no ppt | no ppt | no ppt |
| 31 | 10 | 3 | EtOH | 0.5 | Ethomeen C/12 | 0.5 | film | ppt | ppt |
| 32 | 10 | 3 | EtOH | 0.5 | Hitec | 0.5 | no ppt | no ppt | no ppt |

*S600 N is not an amine. It is a lubricating oil base stock.

EXAMPLE 3

The following blends (Table 3) contain 10 grams of Aromatic 100 and 5 grams of Tolad 9103. The higher concentration of Tolad 9103 necessitates more compatibilizing agent. Only one compatibilizer was most effective. This was a 50/50 mixture of Ethanol and Ethomeen C/12. Note that this 50/50 mixture was less effective in the table above, when only 3 grams of Tolad 9103 was used. A repeat of this experiment confirmed that the combination of ethanol and Ethomeen C/12 is most effective with the higher dosage of Tolad.

Another compatibilizer which is partially effective in the table below is a mixture of Exxal 8 (iso-octanol) and Ethomeen C/12.

TABLE 3

| Blend No. | Aromatic 100 gms | T9103 gms | Alcohol Type | Alcohol gms | Amine Type | Amine gms | Status after 3 days | Status after 7 days | Status after 13 days |
|---|---|---|---|---|---|---|---|---|---|
| 9 | 10 | 5 | none | | FD100 | 1 | ppt | ppt | ppt |
| 10 | 10 | 5 | none | | Ethomeen C/12 | 1 | ppt | ppt | ppt |
| 11 | 10 | 5 | none | | Hitec | 1 | ppt | ppt | ppt |
| 12 | 10 | 5 | Exxal 8 | 1 | none | | ppt | ppt | ppt |
| 13 | 10 | 5 | none | | S600 N* | 1 | ppt | ppt | ppt |
| 15 | 10 | 5 | none | | Armeen RT-97 | 1 | ppt | ppt | ppt |
| 16 | 10 | 5 | EtOH | 1 | none | | ppt | ppt | ppt |
| 18 | 10 | 5 | none | | none | | ppt | ppt | ppt |
| 19 | 10 | 5 | Exxal 8 | 0.5 | FD100 | 0.5 | ppt | ppt | ppt |
| 20 | 10 | 5 | Exxal 8 | 0.5 | Ethomeen C/12 | 0.5 | no ppt | ppt | ppt |
| 21 | 10 | 5 | Exxal 8 | 0.5 | Hitec | 0.5 | ppt | ppt | ppt |
| 26 | 10 | 5 | EtOH | 0.5 | FD 100 | 0.5 | ppt | ppt | ppt |
| 27 | 10 | 5 | EtOH | 0.5 | Ethomeen C/12 | 0.5 | no ppt | no ppt | no ppt |
| 28 | 10 | 5 | EtOH | 0.5 | Hitec | 0.5 | ppt | ppt | ppt |
| 42 | 10 | 5 | — | — | FD100 | 1.7 | thick | — | — |
| 43 | 10 | 5 | — | — | Ethomeen C/12 | 1.7 | ppt | — | — |
| 44 | 10 | 5 | — | — | Hitec | 1.7 | ppt | — | — |
| 45 | 10 | 5 | Exxal 8 | 1.7 | — | — | no ppt | — | — |
| 47 | 10 | 5 | — | — | Armeen H-97 | 1.7 | ppt | — | — |
| 48 | 10 | 5 | EtOH | 1.7 | — | — | no ppt | — | — |

*S600 N is not an amine. It is a lubricating oil base stock.

EXAMPLE 4

The data tabulated (Table 4) demonstrate that the compatibilizer is best if it contains more than 1 part alcohol to 9 parts amine.

TABLE 4

| Blend No. | Aromatic 100 gms | T9103 gms | Alcohol Type | Alcohol gms | Amine type | Amine gms | Status after 3 days | Status after 7 days |
|---|---|---|---|---|---|---|---|---|
| 33 | 10 | 5 | EtOH | .1 | Ethomeen C/12 | .9 | ppt | ppt |
| 34 | 10 | 5 | EtOH | .3 | Ethomeen C/12 | .7 | no ppt | no ppt |
| 35 | 10 | 5 | EtOH | .7 | Ethomeen C/12 | .3 | no ppt | no ppt |
| 36 | 10 | 5 | EtOH | .9 | Ethomeen C/12 | .1 | no ppt | no ppt |

EXAMPLE 5

The data tabulated below (Table 5) demonstrate that the most preferred compatibilizer is effective at low concentrations. The concentration of amine plus alcohol compatibilizer should be about 3 parts or more compatibilizer to 25 parts lubricity additive.

TABLE 5

| Blend No. | Aromatic 100 gms | T9103 gms | Alcohol Type | Alcohol gms | Amine type | Amine gms | Status after 3 days | Status after 7 days |
|---|---|---|---|---|---|---|---|---|
| 37 | 10 | 5 | EtOH | .4 | Ethomeen C/12 | .4 | no ppt | no ppt |

TABLE 5-continued

| Blend No. | Aromatic 100 gms | T9103 gms | Alcohol Type | Alcohol gms | Amine type | Amine gms | Status after 3 days | Status after 7 days |
|---|---|---|---|---|---|---|---|---|
| 38 | 10 | 5 | EtOH | .3 | Ethomeen C/12 | .3 | no ppt | no ppt |

The additive concentrate may, of course, contain other typical components such as detergents, carrier fluids, octane boosters, antioxidants, metal corrosion inhibitor (especially copper corrosion inhibitors), and the like.

EXAMPLE 6

The formulations tabulated below (Table 6) are presented to demonstrate the negative impact water has on formulations containing acid lubricity, additive, aromatic solvent and mixed alcohol/amine compatibilizers.

TABLE 6

| Blend No. | Water (g) | Tolad (g) | ETOH (g) | Armak 1281 Amine (g) | Aromatic 100 (g) |
|---|---|---|---|---|---|
| 39 | 15 | 15 | 10 | 5 | 20 |
| 40 | 5 | 15 | 10 | 5 | 20 |
| 41 | 2 | 15 | 10 | 5 | 20 |
| 42 | 0 | 15 | 10 | 5 | 2 |

Blends were observed at room temperature after shaking, after two days at 28° F., and after one day at approximately 0° F.

Blends 39 and 40 were unstable under all conditions. Upon shacking they formed a thick emulsion. After settling, the blends separated into distinct phases. Blends 41 and 42 were stable at room temperature and at 28° F. (about −2° C). They became thick and hazy only after being held for one day at 0° F. (about −18° C.). It is apparent that water contents of about 5 wt % and higher are detrimental to the stability of the system at room temperature and below.

What is claimed is:

1. A gasoline lubricity additive concentrate comprising a lubricity additive selected from the group consisting of saturated and unsaturated fatty acids, oligomerized saturated and unsaturated fatty acids, esters of such fatty acids and of oligomerized fatty acids and mixtures thereof in an aromatic solvent, said lubricity additive being present in the solvent in an amount of about 85 wt % or less, and containing a compatibilizer which remains liquid to a temperature of at least about 0° C. (32° F.) selected from the group consisting of alcohol, a $C_{12}$–$C_{50}$ amine, and mixtures of alcohol and $C_{12}$–$C_{100}$ amine wherein the alcohol or amine when used individually is present in an amount of at least about 30 wt % based on the weight of lubricity additive, wherein the combination alcohol and amine is used in a ratio of alcohol to amine of about 2:10 to 10:1, the combination is employed in an amount of about 10 to 50 wt % based on the weight of lubricity additive, and wherein when the lubricity additive is present in the solvent in an amount of between about 85 wt % to 8 wt % the amine compatibilizer when used alone is a $C_{51}$–$C_{100}$ amine which remains liquid to a temperature of at least about 0° C. (32° C.), said amine being present in an amount of at least about 30 wt % based on the weight of lubricity additive, the concentrate containing less than about 2 wt % water.

2. The concentrate of claim 1 wherein the alcohol is a $C_2$ to $C_{10}$ alcohol.

3. The concentrate of claim 1 or 2 wherein the amine or alcohol, when used individually, is present in an amount of at least about 35 wt %.

4. The concentrate of claim 1 or 2 wherein the alcohol is used at a concentration of at least about 30 wt % based on lubricity additive when the lubricity additive concentration is about 50 wt % or less.

5. The concentrate of claim 1 or 2 wherein the combination alcohol plus amine is used at a concentration of at least about 10 wt % based on lubricity additive when the lubricity additive concentration is about 30 wt % and higher.

6. The concentrate of claim 1 or 2 wherein the compatibilizer is alcohol.

7. The concentrate of claim 1 or 2 wherein the lubricity additive is selected from the group consisting of saturated and unsaturated fatty acids, oligomerized saturated and unsaturated fatty acids and mixtures thereof.

8. The concentrate of claim 1 or 2 wherein the amine is used at a concentration of at least about 30 wt % based on lubricity additive when the lubricity additive concentration is about 50 wt % to 10 wt %.

9. The concentrate of claim 1 or 2 wherein the alcohol is present in an amount of at least about 30 wt % based on lubricity additive when the lubricity additive concentration in the diluent is about 50 wt % or less.

10. The concentrate of claim 7 wherein the compatibilizer is alcohol present in an amount of at least about 30 wt % based on lubricity additive.

11. The concentrate of claim 7 wherein the compatibilizer is the combination of amine plus alcohol present in an amount of at least about 10 wt % based on lubricity additive.

12. The concentrate of claim 1 or 2 wherein the lubricity additive is selected from the group consisting of the esters of saturated and unsaturated fatty acids, esters of oligomerized saturated and unsaturated fatty acids and mixtures thereof.

13. The concentrate of claim 12 wherein the compatibilizer is alcohol present in an amount of at least about 30 wt % based on lubricity additives.

14. The concentrate of claim 12 wherein the compatibilizer is amine present in an amount of at least about 30 wt % based on lubricity additive when the lubricity additive concentration in diluent is between about 50 wt % to 10 wt %.

15. The concentrate of claim 12 wherein the compatibilizer is the combination amine plus alcohol present in an amount of at least about 10 wt % based on lubricity addition.

16. A method for maintaining a mixture comprising a lubricity additive selected from the group consisting of saturated and unsaturated fatty acids, oligomerized saturated and unsaturated fatty acids, esters of such fatty acids and of oligomerized fatty acids and mixtures thereof in an aromatic solvent in any amount of about 85 wt % or less, said mixture containing less than about 2 wt % water, in the liquid state at low temperatures comprising adding to said mixture of lubricity additive in aromatic solvent a compatibilizer which remains liquid to a temperature of at least about 0° C. (32° F.) selected from the group consisting of alcohol, $C_{12}$–$C_{50}$ amine, and mixtures of alcohol and $C_{12}$–$C_{100}$ amine wherein the alcohol or amine when used individually is present in an amount of at least about 30 wt % based on the weight of lubricity additive and wherein when the combination alcohol and amine are used in the ratio of alcohol to amine ranges from about 2:10 to 10:1, and the combination of alcohol and amine is employed in an amount of about 10 to 50 wt % based on the weight of lubricity additive and wherein when the lubricity additive is present in the solvent in an amount of between about 85 wt % to 8 wt % the amine compatibilizer when used alone is a $C_{51}$–$C_{100}$ amine which remains liquid to a temperature of at least about 0° C. (32° C.), said amine being present in an amount of at least about 30 wt % based on the weight of lubricity additive.

17. The method of claim 16 wherein the alcohol is a $C_2$ to $C_{10}$ alcohol.

18. The method of claim 16 or 17 wherein the amine or alcohol, when used individually, is present in an amount of at least about 35 wt %.

19. The method of claim 16 or 17 wherein the alcohol or amine is used at a concentration of at least about 30 wt % based on lubricity additive when the lubricity additive concentration in the aromatic solvent is about 50 wt % or less.

20. The method of claim 16 or 17 wherein the combination alcohol plus amine is used at a concentration of at least about 10 wt % based on lubricity additive when the lubricity additive concentration in the aromatic solvent is about 30 wt % and higher.

21. The method of claim 16 or 17 wherein the compatibilizer is alcohol.

22. The method of claim 16 or 17 wherein the lubricity additive is selected from the group consisting of saturated and unsaturated fatty acids, oligomerized saturated and unsaturated fatty acids and mixtures thereof.

23. The method of claim 16 or 17 wherein the amine is used at a concentration of at least about 30 wt % based on lubricity additive when the lubricity additive concentration in the aromatic solvent is between about 30 wt % to 10 wt %.

24. The method of claim 16 or 17 wherein the alcohol is present in an amount of at least about 30 wt % based on lubricity additive when the lubricity additive concentration in the aromatic solvent is about 50 wt % or less.

25. The method of claim 22 wherein the compatibilizer is alcohol present in an amount of at least about 30 wt % based on lubricity additive.

26. The method of claim 22 wherein the compatibilizer is amine present in an amount of at least about 30 wt % based on lubricity additive when the lubricity additive concentration in the aromatic solvent is between about 30 wt % to 10 wt %.

27. The method of claim 22 wherein the compatibilizer is the combination of amine plus alcohol present in an amount of at least about 10 wt % based on lubricity additive.

28. The method of claim 16 or 17 wherein the lubricity additive is selected from the group consisting of the esters of saturated and unsaturated fatty acids, esters of oligomerized saturated and unsaturated fatty acids and mixtures thereof.

29. The method of claim 28 wherein the compatibilizer is alcohol present in an amount of at least about 30 wt % based on lubricity additives.

30. The method of claim 28 wherein the compatibilizer is amine present in an amount of at least about 30 wt % based on lubricity additive when the lubricity additive concentration in diluent is between about 30 wt % to 10 wt %.

31. The method of claim 28 wherein the compatibilizer is the combination amine plus alcohol present in an amount of at least about 10 wt % based on lubricity addition.

* * * * *